United States Patent [19]

Van Winkle

[11] Patent Number: 4,690,033

[45] Date of Patent: Sep. 1, 1987

[54] SELF ACTUATING LOCKING AND UNLOCKING ARRANGEMENT AND METHOD FOR RECIPROCATING PISTON TYPE ACTUATORS

[76] Inventor: Denzal W. Van Winkle, P.O. Box 79727, Houston, Tex. 77279

[21] Appl. No.: 807,735

[22] Filed: Dec. 16, 1985

[51] Int. Cl.[4] ..... F15B 15/26

[52] U.S. Cl. ..... 91/43; 91/44; 91/45; 92/27

[58] Field of Search ..... 92/24, 27, 28; 91/43, 91/44, 45

[56] References Cited

U.S. PATENT DOCUMENTS

| | | | |
|---|---|---|---|
| 2,130,618 | 9/1938 | Gnaui | 92/27 X |
| 2,532,768 | 7/1950 | Halward | 91/44 |
| 3,141,382 | 7/1964 | Oldfield et al. | 91/45 X |
| 3,208,357 | 9/1965 | Allen et al. | 92/27 |
| 3,270,621 | 9/1966 | De Ridder | 91/45 X |

FOREIGN PATENT DOCUMENTS

| | | | |
|---|---|---|---|
| 307220 | 8/1918 | Fed. Rep. of Germany | 91/44 |
| 1098365 | 1/1961 | Fed. Rep. of Germany | 91/44 |

*Primary Examiner*—Robert E. Garrett
*Assistant Examiner*—Mark A. Williamson
*Attorney, Agent, or Firm*—Jack W. Hayden

[57] ABSTRACT

A method and arrangement for reciprocating a piston in a cylinder of a fluid actuated actuator between one and another alternate positions, and using the piston fluid actuator fluid to move a lock member from a first position to a second position to lock the cylinder when it is moved from one position to its other alternate position. Actuator fluid is communicated to unlock the lock member and to move the piston back to its one position. In another form, the lock member is moved to its first position by the actuator pressure fluid which actuates a valve to communicate actuator fluid pressure from the lock member to the cylinder to move the piston back to its said other position.

4 Claims, 5 Drawing Figures

FIG. 2
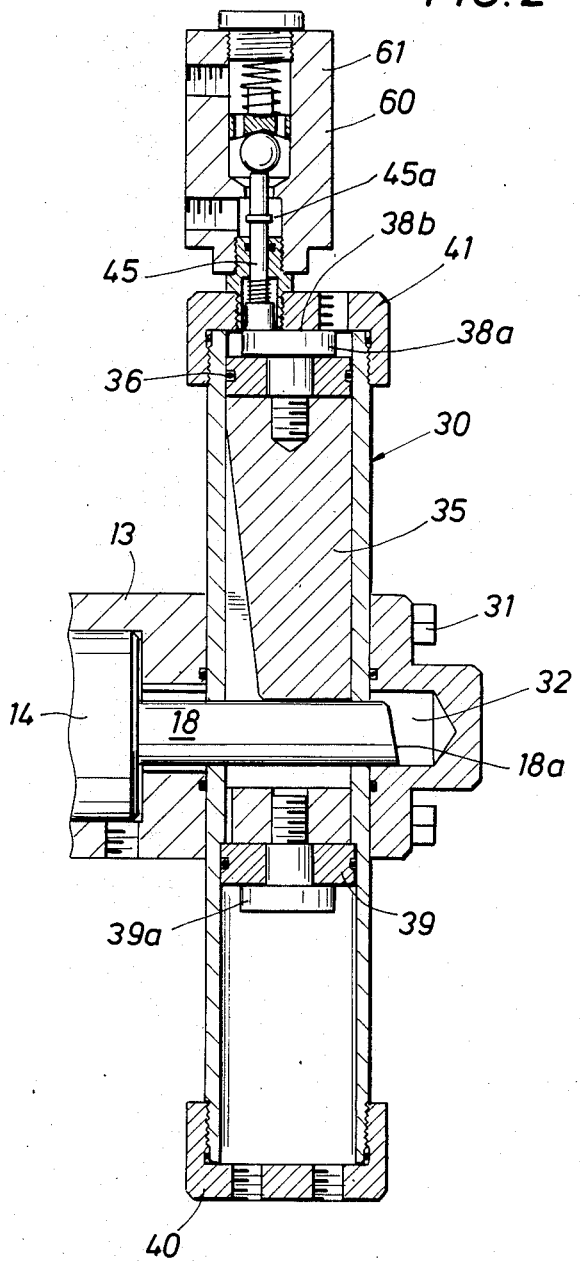
FIG. 3
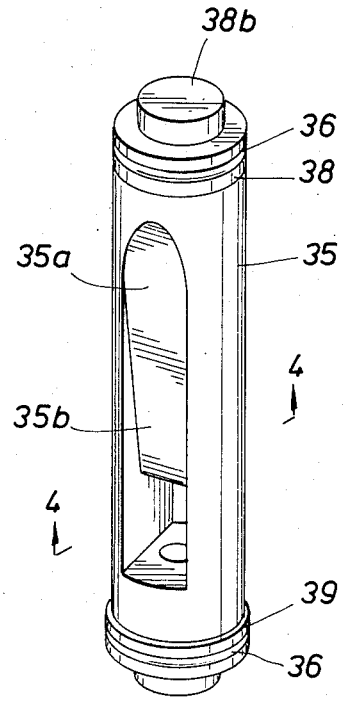
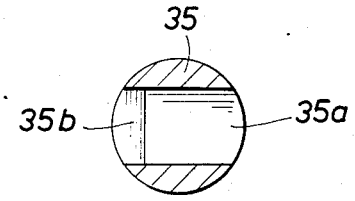
FIG. 4
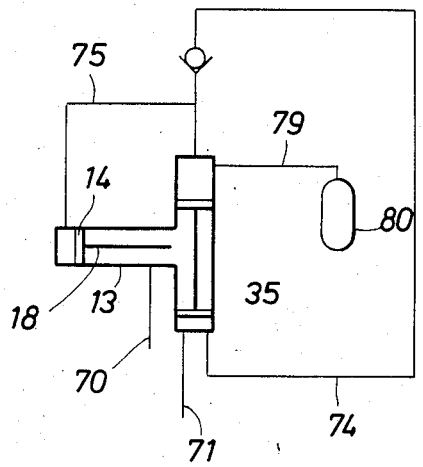
FIG. 5

SELF ACTUATING LOCKING AND UNLOCKING ARRANGEMENT AND METHOD FOR RECIPROCATING PISTON TYPE ACTUATORS

BACKGROUND OF THE INVENTION

A locking and unlocking arrangement for reciprocating piston type actuators is described in U.S. Pat. No. 3,208,357. However, in such device the pressure fluid employed in connection with the actuator is independent of and functions separately from the pressure fluid that actuates the locking means. Where the actuator is a device such as a blowout preventer employed in water covered areas, particularly in connection with oil and gas wells, such arrangement is somewhat complicated and may create problems.

The construction and operation of a blowout preventer in connection with the drilling and production of an oil and gas well is well understood by those skilled in the art. Where such devices are employed in offshore operations, or in other water covered areas, the location of the blowout preventer is remote relative to the controls and so far as know to applicant, all devices currently in use, and including that which is shown in U.S. Pat. No. 3,208,357 requires four separate fluid operating lines in connection with controlling the various positions of the components.

For example, one control line is employed to operate the blowout preventer rams to move them to closed position; a second pressure fluid line extends from the remote control position into the water covered area or other somewhat substantial inaccessible location of the blowout preventer to lock the rams in closed position about a drill pipe or other well bore tubular member; a third line is employed to supply fluid pressure to the blowout preventer to unlock the arrangement which locks the rams in closed position; and yet a fourth line is emloyed to actuate the blowout preventer rams and retract them from closed position back to open position after the lock arrangement has been actuated to unlock the rams to accommodate such retraction.

The use of four separate fluid pressure conduits complicates the operation and use of a blowout preventer ram, or other similar piston type fluid actuator which is located in a remote location. Such lines may become fouled, damaged or other conditions may interfere with their satisfactory use. Some preventer constructions may severly restrict the practical use of lock arrangements presently used.

SUMMARY OF THE INVENTION

The present invention provides an actuator, and more particularly an arrangement for a reciprocating piston type actuator such as a blowout preventer wherein the actuating pressure fluid which actuates the piston of the actuator to move it in the cylinder of the actuator is also communicated to the lock mechanism to operate it. Thus, in the present invention when the piston of the actuator is actuated to move an object, such as the ram of a blowout preventer from open to closed position, the ram will automatically lock in closed position since the actuating fluid for the fluid actuator is also communicated to the locking arrangement to actuate and maintain the rams in locked, closed position.

Similarly, when it is desired to reciprocate the piston of the fluid actuator to move it back to its original or first position in the cylinder, the fluid pressure employed to accomplish movement of the piston is first utilized to deactivate or unlock the lock means from the piston, and then actuating fluid of the actuator is conducted from the lock means to the cylinder of the actuator and act on the piston and reciprocate it so as to retract the device with which the piston rod of the piston is connected, such as the ram of a blowout preventer.

This arrangement and method therefore eliminates two separate steps and conduits heretofore employed in operating a reciprocating piston type actuator, such as employed in connection with a blowout preventer for closing, locking, unlocking and then opening the rams of a blowout preventer. The device is substantially automatic in operation in that when the rams of the blowout preventer are moved to closed position, the fluid operating pressure which accomplishes this movement communicates to position the lock means so that it automatically engages and locks the rams in closed position until it is desired to thereafter open the rams. Thereupon, the actuating fluid is communicated with the lock arrangement to first unlock the rams to accommodate retraction thereof and thereafter supply the operating or actuating fluid from the lock means to the piston of the actuator to automatically retract the rams, or move them to open position after the lock means is actuated.

Other objects and advantages of the present invention will become more readily apparent from a consideration of the following drawings and descriptions.

BRIEF DESCRIPTION OF THE DRAWINGS

FIG. 2 is a partial sectional view illustrating the position of the locking device when the piston actuating pressure has been employed to release the lock and then communicated from the lock to the cylinder to enable the rams of the blowout preventer to be retracted;

FIG. 3 is a perspective view showing a preferred embodiment of the lock member employed to accomplish the locking and unlocking of the actuator;

FIG. 4 is a sectional view on the line 4—4 of FIG. 3 to better illustrate structural details of the member shown therein; and FIG. 5 is a schematic representation of the present invention and actuator, diagrammatically representing the components and the arrangement of the dual fluid pressure conduits employed with the present invention.

DESCRIPTION OF THE PREFERRED EMBODIMENT

Figure 1:
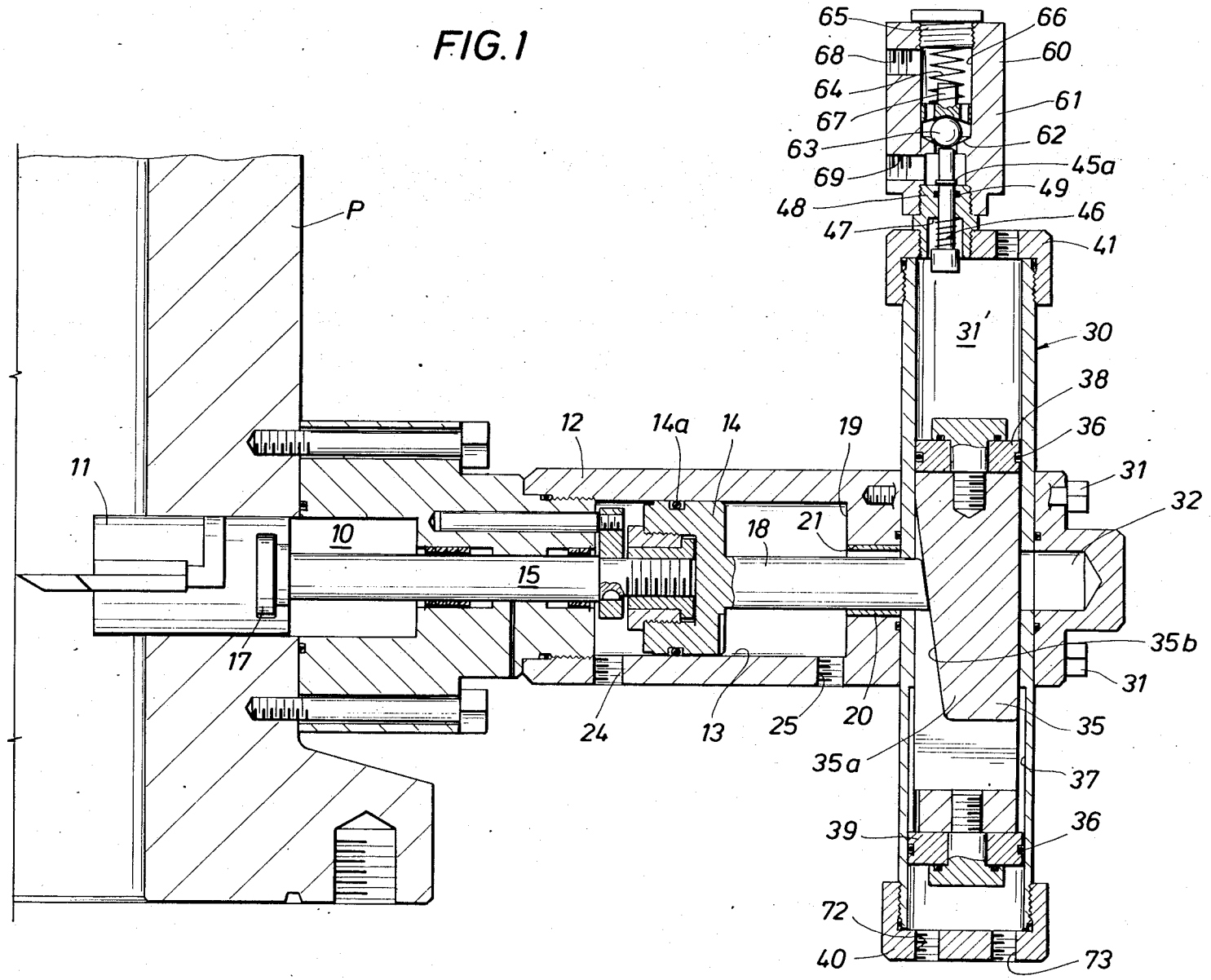
FIG. 1 is a sectional view illustrating the use of the present invention with a reciprocating piston type actuator that is connected to a blowout preventer ram and shows the arrangement wherein the ram is locked in extended or closed position.

The present invention will be described in detail as it relates to its use in connection with a blowout preventer as a fluid pressure operated actuator, and one ram is illustrated in FIG. 1 of the drawings. To those skilled in the art, it will be understood that an additional ram and arrangement of the present invention will be employed to the left of that shown and the rams are diametrically opposed so that a pair of rams move toward each other to accomplish their desired to function to seal off around a member in connection with drilling and production operations employed in oil and gas wells. In actual practice one or more sets of rams may be employed. A lock member will be employed with each actuator for each ram.

A blowout preventer body is referred to by the letter P. An annular bore 10 in body P reciprocably receives the rear portion of each ram 11 of the preventer P and a laterally extending housing 12 secured by any suitable means with the preventer body P provides a cylinder 13 for receiving the piston 14 therein. The cylinder 13 and piston 14 provide a fluid actuator for actuating each ram, and a piston rod 15 is connected to one end of piston 14 to extend through one end of cylinder 13 and is also connected to the ram 11 by any suitable means such as indicated at 17. This structure is well known to those skilled in the art.

A tail rod 18 extends from the piston 14 in the opposite direction relative to the piston rod 15 and extends through the opposite end 19 of the cylinder 13 as shown. Any suitable bearing means 20 may be provided in the opening 21 in cylinder end 19 through which the tail rod 18 extends.

The piston 14 is provided with suitable seal means 14*a* for accommodating sealable reciprocable movement of the piston 14 within the cylinder 13. Suitable inlet ports 24 and 25 are provided in the wall of cylinder 13 on each side of the piston means 14 as shown. The port 25 accommodates entry of pressure fluid from a conduit represented at 70, connected therewith for actuating the piston 14 to move it to the position as illustrated in FIG. 1 of the drawings. When actuator pressure fluid is supplied through the port 24 through conduit 75 as will be described in greater detail hereinafter, the piston 14 is retracted into cylinder 13 and its tail rod 18 extends into bore 32 as shown in FIG. 2 of the drawings.

A body represented at 30 is secured to the actuator, P by any suitable means such as the bolts 31 or the like. The body 30 forms a cylindrical guideway 31' which provides a guideway therein that extends laterally of the cylinder 13 as shown. As previously noted a body 30, and its components as shown in FIG. 1 will be provided for each cylinder of the actuator and an actuator is provided for each ram of the blow out preventer. In the present instance the actuator is demonstrated as being the blowout preventer P. The body 30 is provided with a bore 32 therein to received the tail rod 18 during reciprocation of the piston 14 and a lock member 35 is carried in the guideway 31' to lock and unlock the piston 14 relative to cylinder 13 as will be described. Pistons or annular members 38, 39 are mounted on each end of lock member 35 by any suitable means such as bolts 38*a*, 39*a* respectively and are provided with seals 36 so that pistons 38, 39 are sealably and move reciprocably with lock member 35 in the cylindrical guideway 31' formed in body 30.

It will be noted that the internal diameter of the portion of guideway 31' formed in body 30 which receives the piston 39 of member 35 is somewhat larger as illustrated at 37 than the internal diameter of the portion which receives the piston 38. This provides a differential area so that actuating fluid for the actuator will act on 39 to move lock member 35 in the body 30 as will be described. Also, the guideway 31' communicates with the cylinder 13 around tail rod 18 as shown in the drawings, so that pressure fluid supplied through the port 25 in cylinder 13 also acts in the portion of the guideway 31' between the seals 36 on piston means 38 and 39. Since the piston 39 provides a larger surface area, the actuating pressure fluid which acts on the piston 14 to move it to the left as viewed in FIG. 1 of the drawings and thus close the ram 11 of the preventer P, will also act on the differential area between pistons 38, 39 and move them along with member 35 downwardly towards the bottom of the drawing, as viewed in FIG. 1. Since the same pressure is acting on piston 14 to close the ram 11, that is acting to move the lock member 35 down, after the piston 14 has been moved to the left to close the ram 11, the lock member 35 will be properly and automatically positioned to engage and lock with the tail rod 18. Since the actuating pressure is maintained in cylinder 13, the ram 11 is also kept closed, since this pressure in turn is maintained on the space in body 30 between piston members 38 and 39 to continually urge the member 39 towards the position shown in FIG. 1 to retain the ram 11 locked in position. The differential area between pistons 38, 39 is such that the foregoing is accomplished.

When it is desired to unlock the piston 14 and ram 11 from the position shown in FIG. 1, pressure fluid is supplied through port 72 in body 30 to act on piston 39 of lock member 35 and move it upwardly as viewed in FIG. 1. When lock member 35 has moved upwardly to accommodate positioning of the tail rod 18 in bore 32 as shown in FIG. 2 of the drawings, the end 38*b* of the member 38*a* engaging and holding the piston 38 in position on member 35 will engage the rod 45 and move it upwardly.

The rod 45 projects into guideway 31' and extends through connection 48 in the end cap 41 of the body 30 and into the valve means 60. The valve means 60 is supported in housing 61 in the manner as shown in the drawings. More specifically, rod 45 includes an annular enlarged portion 45*a* which limits its downward movement in connection 48. Spring 46 abuts the shoulder 47 in the counterbore formed in connection 48 which secures the housing 60 to the end cap 41 of the body 30 as shown and an enlargement on rod 45. A suitable seal 49 in the fitting 48 sealably engages with the plunger 45 as shown.

The housing 60 includes a valve seat 62 with a valve member such as the ball valve 63 seated thereon. A spring 64 abuts the plug 65 threadedly engaged in the bore 66 of housing 60 and rests on the moveable guide 67 as shown which moveable guide abuts the ball member 63.

When the lock member 35 has been moved upwardly in response to piston actuating fluid through port 72, engagement with the lower end of rod 45 is effected as demonstrated in FIG. 2 to raise the rod 45. When this occurs the ball valve 63 is moved upwardly off its seat for passage of fluid from inlet port means 68 upstream of valve member 63 through the bore 66 in housing 60 and through the ports in guide 67 around the ball 63 to exit through the exit port 69 which is downstream of the valve 63.

FIG. 5 is schematic representation of the operation of the invention, the conduit 70 being connected with port 25 for supplying actuating fluid to move the piston 14 and ram 11 to the left as viewed in FIG. 1. The actuating fluid pressure on piston 14 in this sequence is simultaneously communicated to the body 30 around tail rod 18 to act between the pistons 38 and 39 and move the piston 39 and lock member 35 down as view in FIG. 1 so that the tapered portion 35*b* engages the tapered end 18*a* of the tail rod and lock the piston 14 in the position shown in FIG. 1. Instead of communicating from the cylinder, operating fluid pressure could be supplied from conduit 70 to the guideway 31' through an interconnection.

When it is desired to retract the ram 11, fluid is supplied through the conduit 71 to port 72 in end cap 40 on body 30. This actuating pressure acts against piston 39 to move the member 35 upwardly toward the position shown in FIG. 2 of the drawings and such actuating pressure communicates through exit port 73, conduit 74 to entry port 68 in housing 60. It then communicates through the unseated ball valve through conduit 75 to cylinder 13 through port 24 and act on the opposite side of the piston 14 and moves piston 14 and ram 11 to the right as viewed in FIGS. 1 and 2.

From the foregoing it will be noted that the actuating pressure for the piston 14 which moves the piston 14 to the left to close ram 11 as shown in FIG. 1 also simultaneously acts on lock member 35 and acts to effect movement of lock member 35 so that the piston 14 and ram 11 are automatically locked and maintained in locked position by the same pressure which is communicated to actuate the piston 14. Similarly, when pressure is conducted through conduit 71 and port 72 to move lock member 35 upwardly as viewed in FIG. 2 of the drawings and unlock the lock member 35 from the tail rod 18, such pressure is then conducted from the lock member 35 through valve means 60 when opened as heretofore described, and such pressure is the operating pressure to move piston 14 to the right and retract it and the ram 11 as heretofore described.

The lock member 35 is shown in FIG. 3 and includes the wedge shaped portion **35*a* having the sloping surface 35*b* thereon which engages with a conforming sloping surface 18*a* on the outer end of the tail rod 18 as shown. Such slope or taper is at an angle such that will not permanently bind or lock together. An opening between the end of wedge and the end of the lock member 35 aligns with the bore 32 in the lock member 35 when the lock member is in the first position and the opening receives the tail rod 18 therethrough as shown. When the opening and bore 32 are aligned, this unlocks the piston 14 for movement from its other position to its said one position as shown in FIG. 2**.

The guideway 31' within the body 30 extends across the bore 32 intermediate the ends thereof, and the various conduit means and port means provide means for communicating the actuating fluid which reciprocates the piston 14 in the cylinder 13 of the actuator with the guideway formed in body 30 for the lock member 35.

The lock member 35 is reciprocably responsive to the actuator actuating fluid of the piston in the cylinder for positioning it between alternate one and the other positions in the guideway 31' of body 30. In the other position as demonstrated in FIG. 1, the lock member 35 engages the tail rod 18 to lock the piston 14 in said other position in the cylinder 13. The one alternate position is demonstrated in FIG. 2 wherein the piston 14 has been unlocked from its other position and moved in response to pressure actuating fluid thereon supplied through conduit means 71, port 72, port 73, conduit 74 and through valve means 60 to conduit 75 and then port 24. A closed reservoir 80 communicates through conduit 79 to the port in end cap 41 so as to accommodate reciprocation of the lock member 35 in guideway 31' while preventing entry of sea water. If the invention were used in air, an air filter could be employed in the port in cap 41.

By making piston 39 sufficiently large, the differential area between pistons 38 and 39 is such that valve 60 may be eliminated. In this event pressure fluid is communicated simultaneously to lock member 35 in body 30 and to cylinder 13 through port 24 to act on piston 14 to move it back to its said one position. To accomplish the foregoing, conduit 74 is connected from body 30 to port 24 in cylinder 13, so that the valve means 60 is eliminated, or a separate line, such as 75, is connected with 71 and to the cylinder port 24 which eliminates the conduit between body 30 and cylinder 13.

The foregoing disclosure and description are illustrative and explanatory of the invention, and various changes in the size, shape and materials as well as the details of the illustrated instructions may be made without departing from the spirit of the invention.

What is claimed is:

1. In a fluid actuator having a cylinder with a piston reciprocable therein between alternate positions by actuating fluid, the invention including:

a rod on the piston extending through one end of the cylinder for connection with a part to be moved, and a tail rod on the piston having an outer end extending through the opposite end of the cylinder;

a body;

a lock member in said body, said lock member having a wedge shaped portion reciprocable between a first position in which said lock member wedge shaped portion is disposed to one side of the tail rod, when said piston is moved to one of its alternate positions, and a second position in which said lock member wedge shaped portion is disposed across the outer end of the tail rod, as said piston is moved toward its other alternate position;

means for simultaneously communicating actuating fluid to the cylinder and to said lock member which maintains said lock member wedge shaped portion and the tail rod outer end in locking relation as the piston moves to and is in the other alternate position;

means including passage means and normally closed valve means therein for controlling communication of actuating fluid to the cylinder for moving the piston to the one alternate position;

means for communicating actuating fluid to said lock member for moving said lock member to the first position; and means operable by said lock member when it is moved to said first position to open said valve means and communicate actuating fluid to the cylinder to move the piston to the one alternate position.

2. The actuator of claim 1 wherein said valve means includes a housing; normally closed ball valve member positioned in said housing; said housing having an inlet port upstream of said normally closed ball valve member for communicating actuating fluid from said body; said housing having an exit port downstream of said normally closed valve member for communicating actuating fluid to the cylinder to move the piston to the one position and means operable by said lock member when it is moved to its first position to actuate said valve member to communicate the inlet port with the exit port.

3. The actuator of claim 2 wherein said means operable by said lock member includes plunger means supported in said housing and extending into said body, spring means normally retaining said plunger adjacent said normally closed ball valve member, said plunger means engagable and movable by said lock member when it is moved to its first position in the guideway to move said ball valve member and communicate actuating fluid from the inlet port to the exit port.

4. The actuator of claim 3 wherein said housing is mounted on said body in which said lock member is reciprocable.

* * * * *

UNITED STATES PATENT AND TRADEMARK OFFICE

CERTIFICATE OF CORRECTION

PATENT NO. : 4,690,033

DATED : September 1, 1987

INVENTOR(S) : Denzal W. Van Winkle

It is certified that error appears in the above-identified patent and that said Letters Patent are hereby corrected as shown below:

In the ABSTRACT, line 5, change "cylinder" to --piston--.

Signed and Sealed this

Second Day of February, 1988

*Attest:*

DONALD J. QUIGG

*Attesting Officer*

*Commissioner of Patents and Trademarks*